United States Patent [19]

Idstein et al.

[11] Patent Number: 4,475,979

[45] Date of Patent: Oct. 9, 1984

[54] METHOD AND APPARATUS FOR TRANSFERRING A TONER IMAGE FROM MOVING PHOTOCONDUCTOR

[75] Inventors: Hermann Idstein, Oestrich-Winkel; Dieter Silbereisen, Taunusstein; Hermann Reininger, Niedernhausen, all of Fed. Rep. of Germany

[73] Assignee: Hoechst Aktiengesellschaft, Frankfurt am Main, Fed. Rep. of Germany

[21] Appl. No.: 441,299

[22] Filed: Nov. 12, 1982

[30] Foreign Application Priority Data

Nov. 20, 1981 [DE] Fed. Rep. of Germany ..... 3145984

[51] Int. Cl.[3] ..... B41F 23/04

[52] U.S. Cl. ..... 156/542; 430/126; 355/3 TR

[58] Field of Search ..... 430/126; 355/3 TR; 427/14.1; 156/542

[56] References Cited

U.S. PATENT DOCUMENTS

| | | | |
|---|---|---|---|
| 3,063,859 | 11/1962 | Heckscher | 117/17.5 |
| 3,554,836 | 1/1971 | Steindorf | 156/240 |
| 4,044,385 | 8/1977 | Nishimura et al. | 358/300 |
| 4,092,925 | 6/1978 | Fromson | 101/467 |
| 4,168,338 | 9/1979 | Kato et al. | 428/219 |
| 4,171,899 | 10/1979 | Yanagawa et al. | 355/3 TR |

*Primary Examiner*—John D. Welsh

*Attorney, Agent, or Firm*—Schwartz, Jeffery, Schwaab, Mack, Blumenthal & Koch

[57] ABSTRACT

A method and an apparatus for transferring a toner image in a transfer zone from a photoconductor to an image carrier 15. The photoconductor is mounted on an upper part 65 of a travelling table 3. The image carrier 15 lies on an inclined feed table, and after the image carrier has been released, it is held on a transport cylinder 17 by means of gripper mechanisms and is urged against the transport cylinder by a first pressure mechanism. A second pivoting pressure mechanism and the transport cylinder convey the image carrier to a third gripper mechanism, which is displaced parallel to an inclined deposit to guide the image carrier in an upward direction via a fixing station and is then opened so that the image carrier drops into the deposit.

14 Claims, 6 Drawing Figures

METHOD AND APPARATUS FOR TRANSFERRING A TONER IMAGE FROM MOVING PHOTOCONDUCTOR

BACKGROUND OF THE INVENTION

The present invention relates to a method of transferring a toner image from a photoconductive surface to an image carrier and also to an apparatus for carrying out this method.

Toner image transfer from a moving photoconductor to a moving image carrier is generally effected with the aid of pressure, heat and/or with the assistance of a corona discharge, when the image carrier comprises paper, a plastic film or a similar material.

From U.S. Pat. No. 3,554,836 a transfer process for toner images is known, in which a toner image is developed on a silicone elastomer surface and is then transferred once or even more than once to further silicone elastomer surfaces and is eventually applied to the final image carrier, without splitting of the toner. In the process, an aluminum plate coated with a silicone elastomer, for example, may be used to form the circumferential surface of a roll, on which an image is present, which is developed by means of a developer. The developed image can subsequently be transferred to another roll which is also coated with a silicone elastomer and, from this roll, it is finally transferred to an image carrier web.

U.S. Pat. No. 4,092,925 describes an apparatus forming part of a printing plate system comprising a recyclable printing member of aluminum carrying a photosensitive coating which, together with the aluminum printing member, constitutes the image face. The aluminum printing member is supported by a carrier plate and is releasably connected thereto. Upon completion of the printing operation, the aluminum printing member is separated from the carrier plate, which can also be reused.

In prior art apparatuses, the image is either first transferred from the photoconductor to an intermediate image carrier and then to the image carrier, or is transferred directly from the photoconductor to an image carrier provided with a light-sensitive coating, without using an intermediate image carrier.

SUMMARY OF THE INVENTION

It is an object of the present invention to provide an improved method for the high-resolution transfer of a toner image from a photoconductive surface to an image carrier.

It is a further object of the invention to provide such a method in which neither an intermediate image carrier nor an image carrier having a light-sensitive coating is used.

Another object of the invention resides in the provision of an apparatus for the high resolution transfer of a toner image from a photoconductive surface to an image carrier.

It is also an object of the invention to provide such an apparatus in which neither an intermediate image carrier nor an image carrier having a light-sensitive coating is used.

In accomplishing the foregoing objects, there has been provided in accordance with one aspect of the present invention a method of transferring a toner image from a photoconductive surface to an image carrier, comprising the steps of moving a flat photoconductive surface at a predetermined speed relative to the image carrier; establishing contact between the photoconductive surface and the image carrier along a single line transverse to the direction of motion and progressively contacting the photoconductive surface and image carrier line-by-line in the direction of motion; and applying a pressure along the line of contact sufficient to transfer the toner image to the image carrier.

In accordance with another aspect of the invention, there has been provided an apparatus for carrying out the method of the invention, comprising means for moving a flat photoconductive surface at a predetermined speed relative to the image carrier; means for establishing contact between the photoconductive surface and the image carrier along a single line transverse to the direction of motion and for progressively contacting the photoconductive surface and image carrier line-by-line in the direction of motion; and means for applying a pressure along the line of contact sufficient to transfer the toner image to the image carrier. Preferably, the contact establishing means comprises a rotatable transport cylinder; a first gripping mechanism associated with the transport cylinder for gripping the leading edge of the image carrier before the contacting and for releasing same after the contacting; a second gripping mechanism associated with the transport cylinder for gripping the trailing edge of the image carrier before the contacting and for releasing same after the contacting; and means associated with the transport cylinder for pressing the image carrier against the outer circumference of the transport cylinder.

Further objects, features and advantages of the present inventon will become apparent from the detailed description of preferred embodiments which follows, when considered together with the attached figures of drawing.

DETAILED DESCRIPTION OF PREFERRED EMBODIMENTS

According to the invention, a flat photoconductive surface is moved at a predetermined speed relative to an image carrier and is in line-contact with the image carrier during toner image transfer, and the toner image is transferred by means of pressure onto the open-pore surface of the image carrier.

The apparatus for carrying out the method of the invention is distinguished by gripper and pressure mechanisms, which are arranged on the circumferential surface of a transport cylinder and by which the image carrier is urged against the circumferential surface of the transport cylinder and clamped thereto and is released again, after the toner image has been transferred from the photoconductive surface to the image carrier.

The invention has the advantage that the photoconductor and the image carrier contact each other only once during toner image transfer and, as a result, a high image resolution is obtained, without indistinct areas and/or blurs, which are frequently encountered, for example, in the case of two or even more contacts in the course of the transfer procedure. Since there is no intermediate image carrier, additional problems of removing any residual toner from an intermediate image carrier do not arise and, moreover, the required equipment construction can be kept small.

In the text which follows, the invention is explained in more detail with reference to an illustrative example of a preferred embodiment shown in the accompanying drawings.

Figure 1:
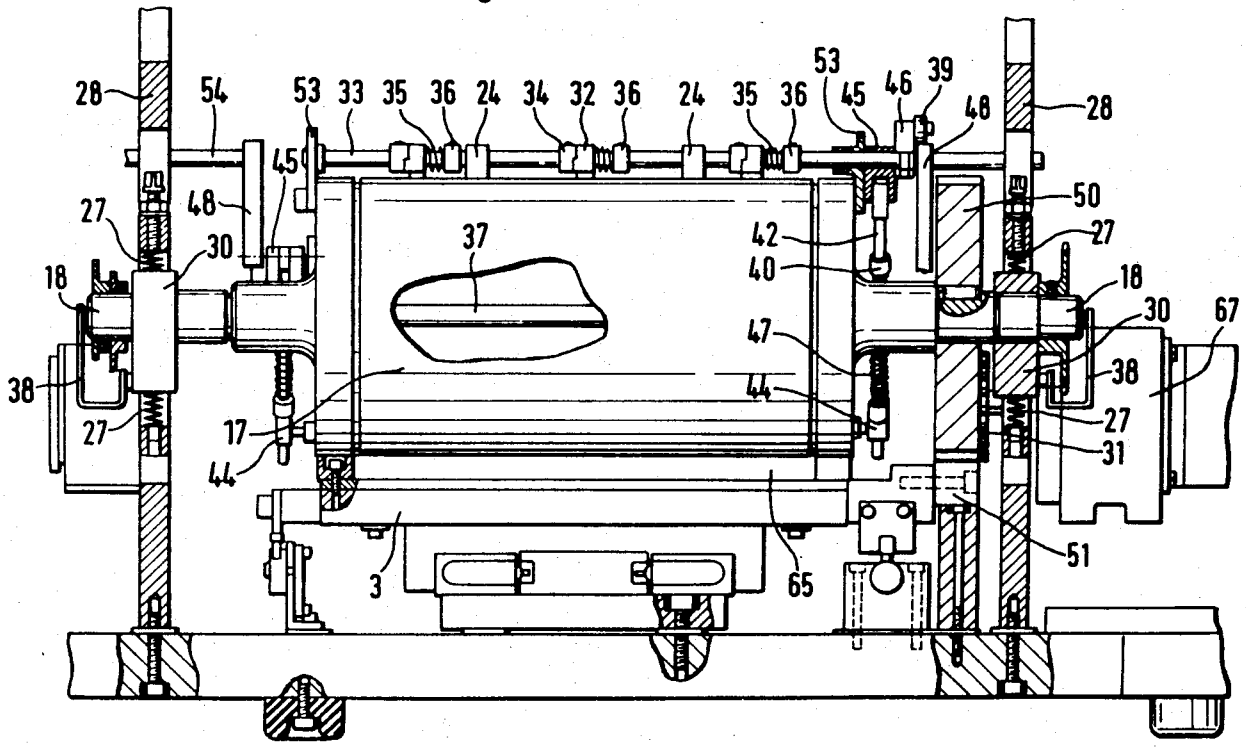
FIG. 1 is a plan view, partly in section and partly cut-away, of the apparatus according to the invention;.

The apparatus shown in FIG. 1 is equipped with a transport cylinder 17, the shaft 18 of which is supported with its end portions in links 30 which are displaceably arranged in side plates 28. As can be seen from FIG. 2, the link 30 is contacted by two vertically extending guide rails 29 disposed on either side thereof and is adapted to move upwardly and downwardly between these guide rails 29. In the embodiment shown in FIG. 1, pressure elements, for example, comprising pretensioned compression springs 27, are provided above and below each link 30. The compression springs 27 abut the top and bottom surfaces of the link 30, and by their action the space between the upper surface of an upper part 65 of a travelling table and the shell surface of the transport cylinder 17 adjusts itself differently, according to the thickness of an image carrier 15 (see FIG. 3), since the shaft 18 of the transport cylinder 17 is vertically displaceable against the respective pressures of the springs 27.

Figure 2:
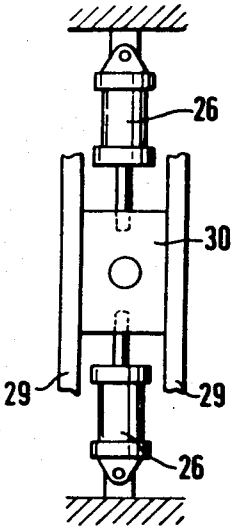
FIG. 2 is a side view of a detail of the apparatus according to FIG. 1.

As shown in FIG. 2, it is also possible to provide hydraulic or pneumatic cylinders 26 as the pressure elements for each link 30. These cylinders are disposed in the side plate 28 above and below the link 30, and their piston rods are connected with the link 30.

A gripper mechanism is arranged on a shaft 33 above the transport cylinder 17 and comprises gripper fingers 32 acting together with coupling pieces 34. Each gripper finger 32 can be closed by means of a leg spring 35 which is positioned between the gripper finger 32 and a locking ring 36. In addition, stops 24 are seated on the shaft 33. Since the gripper mechanism is of conventional design, its operation is only briefly mentioned. A control lever 46 of the gripper mechanism carries and actuating roller 39 which rides on a cam 48. The lever 46 is swivelled by the cam 48 and the gripper fingers 32 are opened or closed, correspondingly. A forked piece 45 adjacent to the lever 46 is engaged by a lifting rod 42 which is surrounded by a compression spring 47 resting with one of its ends against an end support 44 and with its other end against a stop 40. The lifting rod 42 and the forked piece 45, as well as the lever 46 together with the actuating roller 39 and the cam 48 are disposed between one end face of the transport cylinder 17 and the inner side of one of the side plates 28. Between the lifting rod 42 and the righthand side plate 28 in FIG. 1, a gear wheel 50 is mounted on the shaft 18 and mates with a rack 51 which is attached laterally to the travelling table 3.

The rack 51 is moved back and forth by a gear wheel 31 which is connected to a DC motor 67. By means of the gear wheel 50, which mates with the rack 51, the transport cylinder 17 is rotated together with the image carrier 15, for example, comprising an aluminum sheet which is held on the shell surface of the transport cylinder 17 by means of the gripper mechanism.

A heat radiator 37 is centrally disposed in the interior of the transport cylinder 17 and is supported at its ends in the end portions of the shaft 18 of the transport cylinder 17. The ends of the heat radiator 37 are connected to fixtures 38 which are attached to the end faces of the shaft 18. The heat radiator is controlled so that the surface temperature of the transport cylinder 17 and of the aluminum plate 15, respectively, is in the range of from about 100° to 125° C. during the transfer of the toner image from the photoconductor 19 to the aluminum plate 15. At these temperatures, contact pressures of up to about 100 N/cm will yield a very good image resolution.

It is naturally also possible to provide an unheated transport cylinder 17, but in that case the contact pressure between the photoconductor and the image carrier must be increased to values of up to about 200 N/cm at room temperature. The heat radiator 37 may, for example, be an infrared radiator which has a capacity of 1,600 watts and heats the transport cylinder 17 at the desired surface temperature after a heating-up period of about 7 minutes.

The equipment used for producing images on image carriers, particularly on aluminum printing plates, is described with reference to the over-all schematic view in FIG. 3. The photoconductor 19, for example, a photoconductor film, lies on an upper part 65 of the travelling table 3, which can be horizontally displaced in the forward and backward direction of the double-arrow A. Reduced pressure is applied to hold the photoconductor on the upper part 65 of the travelling table. A charging device 1, preferably a corona charging device, passes over the photoconductor 19 which is thus charged at a predetermined voltage of a particular polarity. Upon termination of the charging procedure, the charging device 1 is returned to its starting position. Then the charged photoconductor is exposed by an exposure station 2 which is arranged above the travelling table 3. After exposure, the travelling table 3 is moved in the direction of the transport cylinder 17 and, on its way, it passes underneath a diagrammatically shown developing station 4, by means of which toner is applied from above to the latent charge image on the photoconductor 19, which is thereby developed into a toner image. The developing station 4 may, for example, be constructed so that it is lowered onto the photoconductor 19 only when toner is to be applied, and is otherwise slightly raised above the path of the photoconductor.

The image carrier or the aluminum printing plate 15, respectively, lies on a feed table 16 which is inclined with respect to the photoconductor path and has such a position that the image carrier 15 contacts the transport cylinder 17 tangentially and obliquely from above. At the lower end of the feed table 16 an arresting means 5 is provided which releases an individual printing plate, when required. When the arresting means 5 is opened, the uppermost printing plate 15 on the feed table 16 drops into an opened-up, first gripper mechanism 6, where its leading edge 22 is positioned by stops 24 (see FIG. 4).

Figure 5:
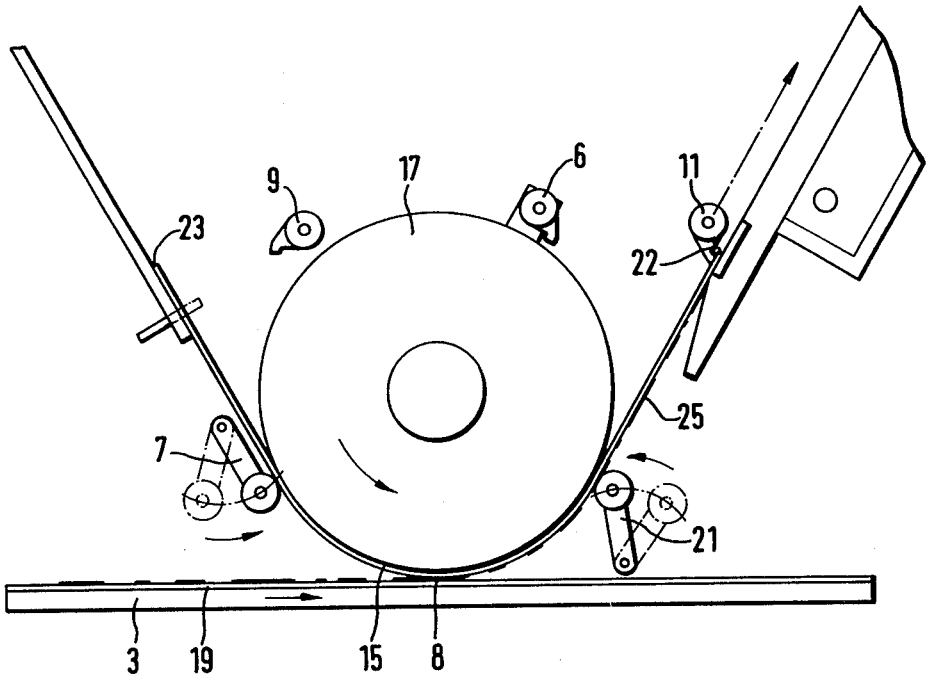

As soon as the toner image 25 on the photoconductor 19 enters into pressure contact with the printing plate 15, the transport cylinder 17, to which the printing plate is clamped, starts to roll over the photoconductor 19 (see FIG. 5). In the process, the toner image 25 is transferred under pressure from the photoconductor 19 to the printing plate 15.

Figure 3:
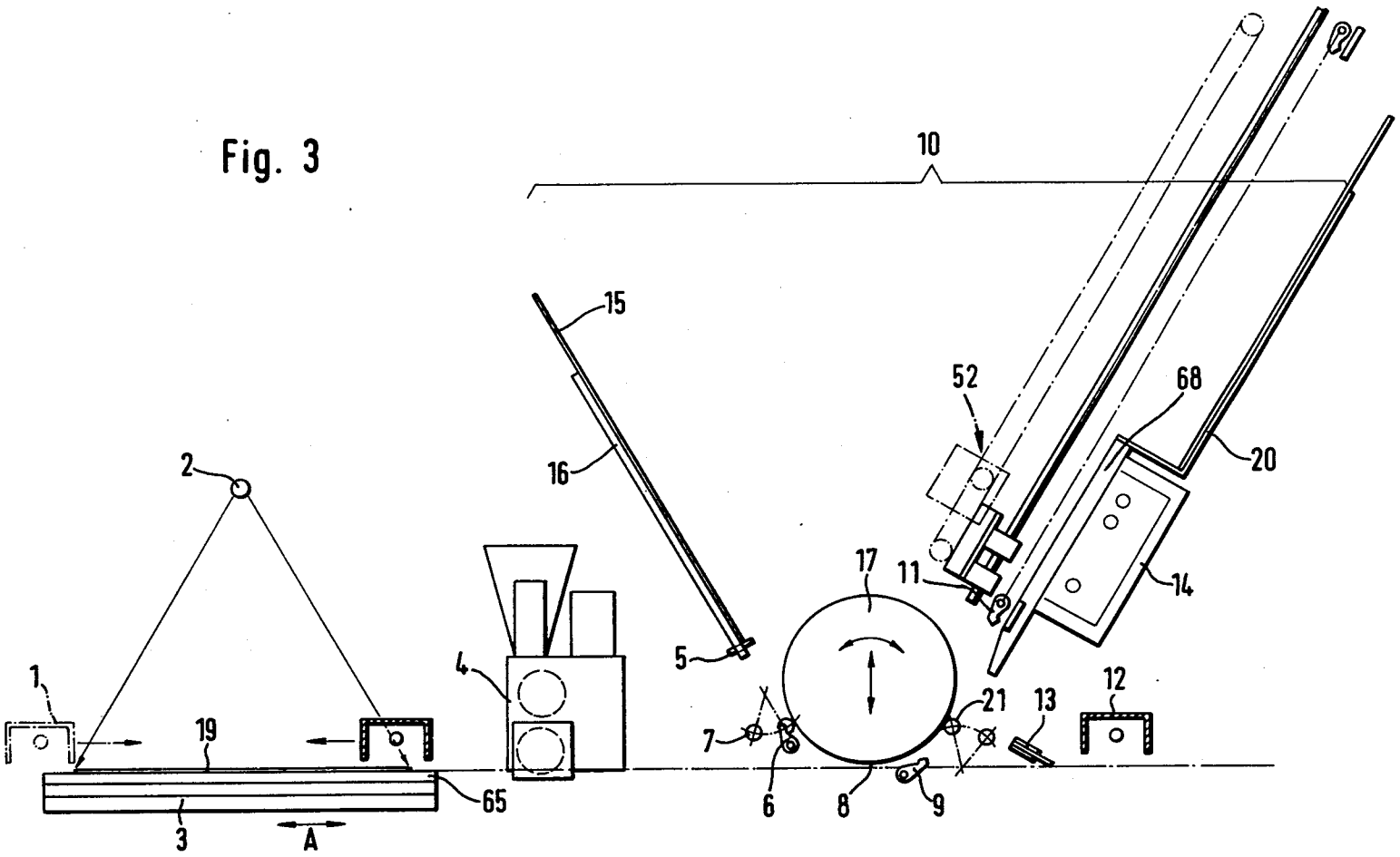
FIG. 3 is a schematic over-all view of a device for producing images on image carriers.

As can be seen from FIG. 3, the first gripper mechanism 6 and a second gripper mechanism 9, which may be entirely identical in their construction, are arranged on the circumferential surface of the transport cylinder 17 to hold the printing plate 15 against the transport cylinder 17. The two gripper mechanisms are supported in cams 53 which are attached to the end faces of the transport cylinder 17. The gripper mechanism 9 which is controlled by a cam 48 serves to retain the rear edge 23 (see FIG. 6) of the printing plate 15 which is thus clamped to the circumferential surface of the transport cylinder 17. Ahead of its point of contact with the transport cylinder 17, the printing plate 15 is urged against the circumferential surface of the transport cylinder 17 by a first pressure mechanism 7 which substantially comprises a pivoting pressure roller. In the further course of the procedure, the opened-up gripper mechanism 9 closes and the rear edge 23 of the printing plate 15 is clamped to the transport cylinder.

The printing plate 15 preferably comprises a metal sheet, for example, an aluminum sheet, as already mentioned, which may have a thickness in the range from about 0.1 to 0.5 mm. The sheet material available for the manufacture of such aluminum sheets has thickness tolerances, according to German Industrial Standards (DIN), which may be in the range between about ±0.008 mm for a 0.1 mm thick aluminum sheet and between about ±0.08 mm for a 0.5 mm thick aluminum sheet. If an aluminum sheet of 370 mm length is passed through the apparatus, this involves deviations due to tolerances which amount to about ±0.3 mm over the path length, for a 0.5 mm thick sheet.

The surface of the printing plate is appropriately electrochemically roughened and has a roughness in the range from about 2 to 8 μm.

A toner image transfer without losses in image quality, i.e., losses in resolution, requires an absolutely synchronous running between the photoconductor 19 which is mounted on the upper part 65 of the travelling table and the circumferential surface which is constituted by the aluminum sheet clamped to the transport cylinder. The aforementioned different path lengths resulting from the permissible variations in the thicknesses of the aluminum sheets act as braking or accelerating forces which are exerted by the aluminum sheet 15 on the photoconductor 19. The stresses and/or frictional forces thereby produced may lead to losses of resolution in larger format lengths. In addition, damage and increased wear may occur between the surface of the photoconductor 19 mounted on the upper part 65 of the travelling table and the surface of the transport cylinder 17, during the reverse movement of the upper part 65 of the travelling table, when the aluminum sheet is no longer on the transport cylinder and the rolling radius is therefore reduced. To prevent this, synchronous running is ensured between the transport cylinder 17 with the printing plate clamped to it and the upper part 65 of the travelling table during pressure contact between these two structural members. For this purpose, German Pat. Application No. P 31 36 659.7 proposes to provide (1) a gear wheel which mates with a rack which is laterally attached to a travelling table; (2) locking members which firmly connect the upper part of the travelling table to the bottom of the travelling table during its forward movement, up to the point of toner image transfer, and which release this connection only at the moment when the photoconductor and the printing plate come into contact with one another; and (3) rolling members which are provided between the upper part and the bottom of the travelling table and ensure that, upon unlocking, the bottom of the travelling table continues to move at its predetermined speed, corresponding to the propulsion of the rack, while the upper part of the travelling table adopts a speed corresponding to the given rolling radius. This is rendered possible by the rolling contact effected by the rolling members which allows an easy displacement of the upper part of the travelling table relative to the travelling table or the bottom thereof.

Upon completion of the toner image transfer, the printing plate 15, with its leading edge facing forward, is conveyed by the transport cylinder 17 in the direction of a third gripper mechanism 11 which is arranged upstream of a fixing device 14. The third gripper mechanism 11 is displaced by means of a driving mechanism 52 parallel to a deposit 20 for the image carriers or printing plates 15. The fixing device 14 is switched on before the printing plate 15 is passed over it. As soon as the third gripper mechanism 11 has reached its highest position, it is opened to release the printing plate 15 which drops into the deposit 20. The fixing device 14 and the deposit 20 are inclined with respect to the horizontal. The deposit 20 is arranged downstream of discharge skids 68, while the fixing device 14 is below the discharge table. The discharge skids 68 extend tangentially to the circumferential surface of the transport cylinder 17 so that the printing plate 15 detaching itself from the transport cylinder 17 is not bent when it settles down on the discharge skids 68, which are laterally disposed outside of the image area of the printing plate 15.

When the travelling table has cleared the transport cylinder 17, it continues to move in the adopted forward direction, until it has passed underneath a cleaning station 13 and a discharging device 12, for example, a corona discharging device which removes any residual voltage still present on the photoconductor 19. The cleaning station 13, which is diagrammatically shown as a cleaning blade, may be arranged before (see FIG. 3) or behind (see FIG. 6) the corona discharging device 12, as viewed in the direction of forward motion. When the travelling table 3 is reversed, the cleaning station 13 is lowered onto the surface of the photoconductor 19 and cleans it of any remaining toner.

Figure 4:
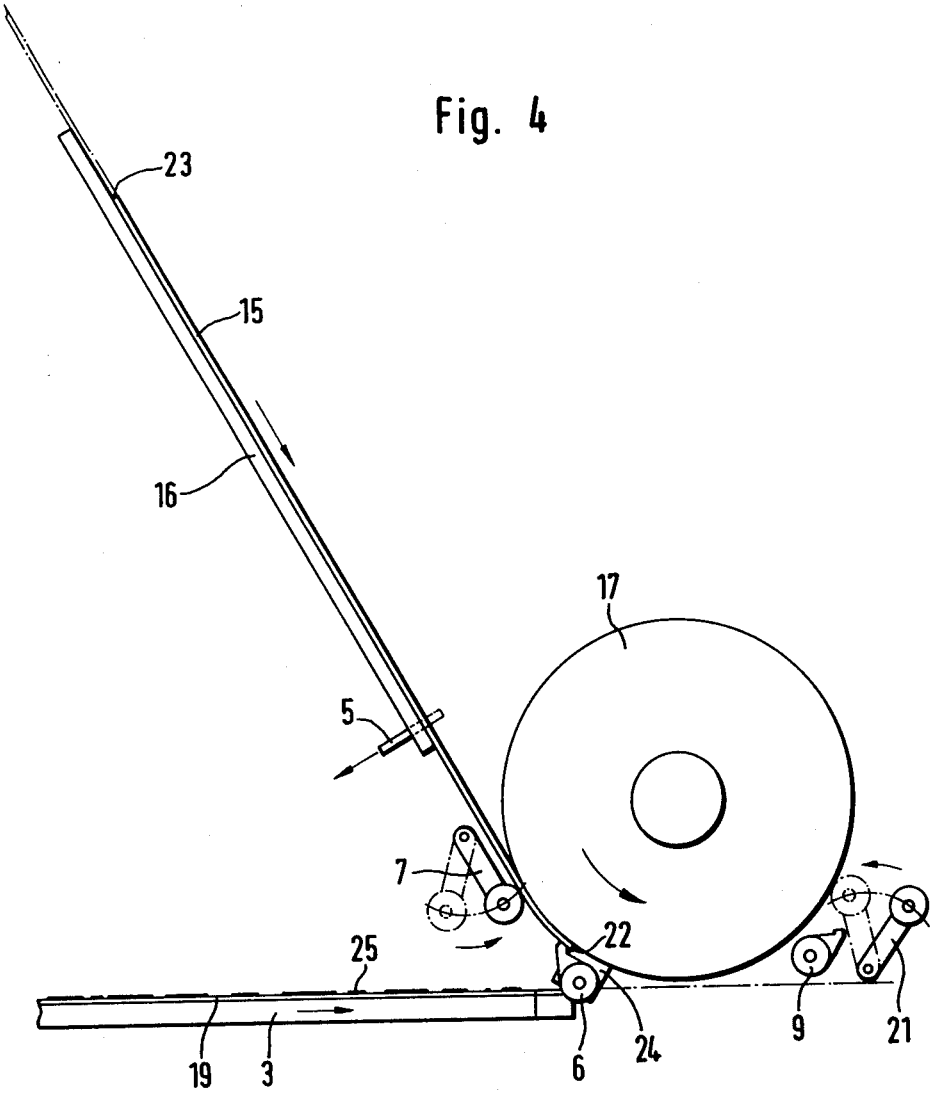
FIGS. 4 to 6 schematically show three different positions of the image carrier relative to the photoconductive surface, in the apparatus of the invention.
Figure 6:
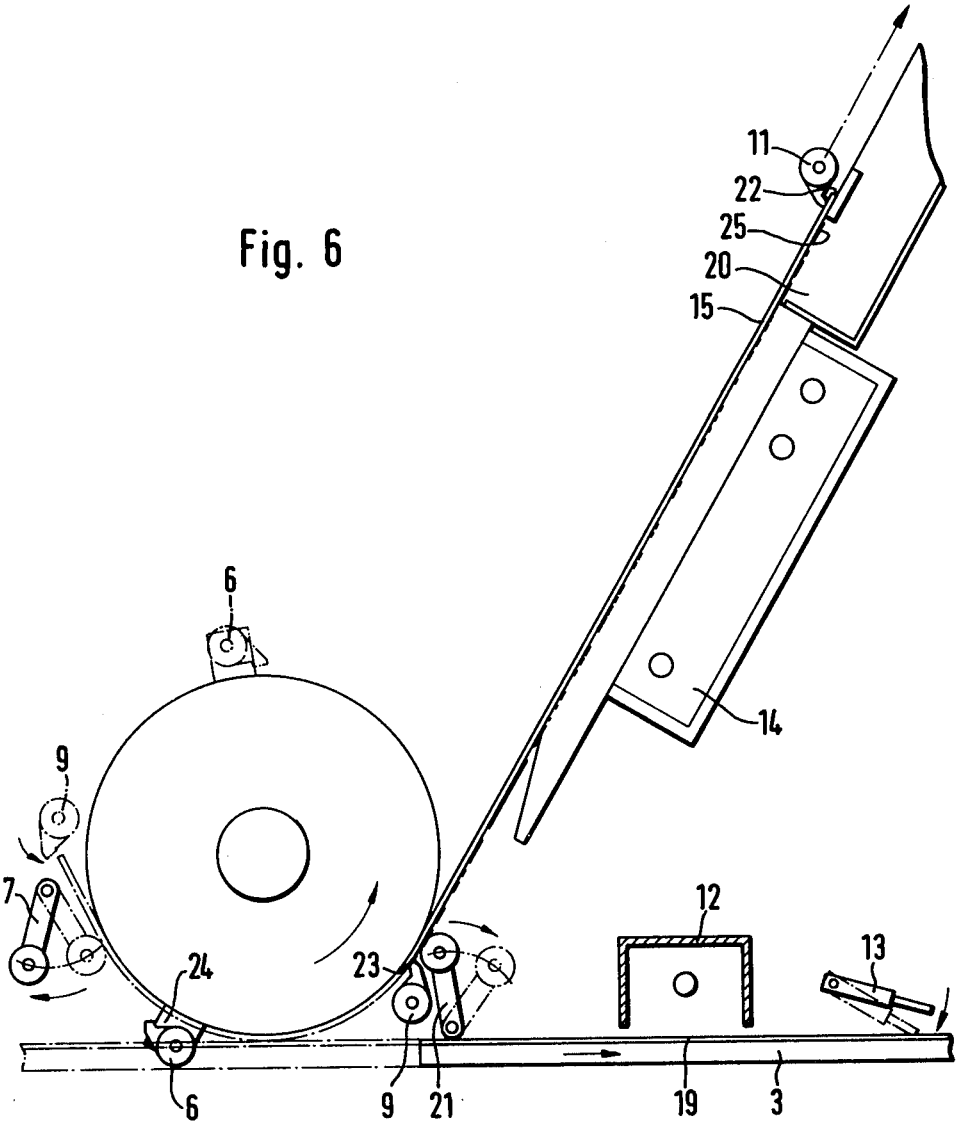

In the text which follows, the apparatus of the invention and its mode of operation are explained in detail with reference to FIGS. 4 to 6. As can be seen from FIG. 4, the leading edge 22 of the printing plate 15 is seized by the first gripper mechanism 6. The first pressure mechanism 7 urges the printing plate 15 against the circumferential surface of the transport cylinder 17. The second pressure mechanism 21 is then pivoted away from the circumferential surface of the transport cylinder 17, by means of the cams 53 (see FIG. 1). This position of the second pressure mechanism 21 is indicated by solid lines in FIG. 4. The second gripper mechanism 9 is opened and also pivoted away from the circumferential surface of the transport cylinder 17, while the first gripper mechanism 6 is closed by the cam control mentioned above in connection with FIG. 1. The transport cylinder 17, which is driven via the gear wheel 50 and the rack 51 (see FIG. 1), rotates synchronously with the speed of the travelling table.

FIG. 5 shows a position in which the toner image 25 has already partly been transferred from the photoconductor to the anodized surface of the printing plate 15 or other image carrier under the action of force exerted by the transport cylinder 17 on the photoconductor 19. The printing plate 15 is partly bent around the circumferential surface of the transport cylinder 17. Its rear edge 23 is still on the feed table 16, while its leading edge 22 is held by the third gripper mechanism 11. In this position, the second pressure mechanism 21 is pivoted in contact with the transport cylinder 17 and helps to transport the printing plate 15 in the direction of the deposit 20. The first and second gripper mechanisms 6 and 9 are then in a high position of the transport cylinder 17. Within a transfer zone 8, the toner image 25 is transferred line by line from the photoconductor 19 to the printing plate 15. By the pressure contact during transfer, the toner particles are anchored in the pores of the anodized surface of the printing plate 15. As soon as the rear edge 23 of the printing plate 15 has left the feed table 16, as indicated by the phantom-line representation of the printing plate and of the second gripper mechanism 9 in FIG. 6, the first pressure mechanism 7 urges the printing plate 15 against the transport cylinder 17. In the further transport, the second gripper mechanism 9 closes and clamps the rear edge of the printing plate 15 to the circumferential surface of the transport cylinder 17. The rear edge 23 of the printing plate 15 is thus prevented from striking against the imaged photoconductor 19, and a high resolution is ensured, even during image transfer in the image area at the trailing end of the printing plate. The third gripper mechanism 11 takes hold of the leading edge 22 of the printing plate 15 and transports it over the switchedon fixing device 14, where the toner image 25 on the printing plate is burnt in or fixed. When the third gripper mechanism 11 has reached its upper end position, it is opened by way of a cam, and the fixed printing plate 15 drops into the deposit 20.

At the same time, the travelling table 3 carrying the photoconductor 19 passes underneath the discharging device 12. When the travelling table 3 has reached its end position, its direction of motion is reversed and it returns to its starting position. In the reverse travel, the photoconductor 19 is cleaned by the lowered cleaning station 13, and frictional forces between the transport cylinder and the photoconductor surface are prevented, e.g., by raising transport cylinder 17. This can be accomplished by introducing a pressure medium into cylinders 26. The developing station 4 is then raised, all drive mechanisms are returned to their respective starting positions, and the heat radiators of the fixing device 14 are switched off.

After feeding-in a fresh printing plate 15, the process cycle is started anew, and the printing plate 15 is imaged and developed as described above.

What is claimed is:

1. An apparatus for transferring a toner image from a photoconductive surface to an image carrier, comprising:

(a) means for moving a substantially planar photoconductive surface tangentially to an image carrier at a predetermined speed relative to said image carrier, said image carrier comprising an open pore metallic surface which is transported along an arcuate path into and away from contact with said photoconductive surface;

(b) means for moving said image carrier in an arcuate path into and away from contact with said photoconductive surface;

(c) means for establishing contact in a transfer zone between said photoconductive surface and said image carrier along a single line of contact which is transverse to the direction in which said photoconductive surface is moving and for progressively contacting said photoconductive surface and image carrier line-by-line in said direction; and (d) means for applying pressure and heat along said line of contact sufficient to transfer said toner image to said image carrier and to anchor, solely by action of pressure and heating, toner particles which comprise said toner image in pores comprising said metallic surface along said line of contact.

2. An apparatus as claimed in claim 1, wherein said means for establishing contact comprises:

a rotatable transport cylinder;

a first gripping mechanism associated with said transport cylinder for gripping the leading edge of the image carrier before said contacting and for releasing same after said contacting; and a second gripping mechanism associated with said transport cylinder for gripping the trailing edge of the image carrier before said contacting and for releasing same after said contacting.

3. An apparatus as claimed in claim 2, wherein said contact establishing means further comprises means associated with said transport cylinder for pressing the image carrier against the outer circumference of the transport cylinder.

4. An apparatus as claimed in claim 3, wherein said means for moving said image carrier comprises a feed table for the image carrier and an image-carrier deposit arranged in a V-shape with respect to the transport cylinder, in such a way than an incoming image carrier and also an outgoing image carrier contact either side of the circumferential surface of the transport cylinder in each case tangentially and at an incline with respect to the horizontal.

5. An apparatus as claimed in claim 4, wherein a shaft of rotation of the transport cylinder is supported in links which are vertically displaceable, and wherein the apparatus includes pressure means for automatically adjusting the distance between the upper side of the photoconductive surface which is mounted on the upper part of the travelling table and the circumferential surface of the transport cylinder during toner image transfer in response to changes in the thickness of the image carrier.

6. An apparatus as claimed in claim 2, further comprising a heating device provided in the interior of the transport cylinder for heating the circumferential surface of the transport cylinder and the image carrier to a temperature below the softening temperature of the toner image.

7. An apparatus as claimed in claim 2, further comprising an image-carrier deposit located downstream of said transport cylinder, and a fixing device arranged upstream of the image-carrier deposit and being oriented so that the image carrier is conveyed by the transport cylinder over the fixing device with its underside facing downwardly.

8. An apparatus as claimed in claim 7, further comprising a third gripper mechanism upstream of said fixing device for gripping the leading edge of the image carrier to convey it over the fixing device and for releasing the image carrier at the image-carrier deposit.

9. An apparatus as claimed in claim 8, further comprising means for displacing the third gripper mechanism parallel to the image-carrier deposit.

10. An apparatus as claimed in claim 9, wherein each of said gripper mechanisms comprises a shaft, a locking ring mounted on said shaft, a gripper finger mounted on said shaft and a leg spring arranged between the gripper finger and the locking ring for closing the gripper finger, and wherein the leg spring within each gripper mechanism includes means for adjusting the spring tension.

11. An apparatus as claimed in claim 5, further comprising means for returning the travelling table past the transport cylinder to a starting position and means for preventing frictional forces between the photoconductive surface and the surface of the transport cylinder during said returning.

12. An apparatus as claimed in claim 11, wherein said preventing means comprises means for raising said transport cylinder out of contact with the photoconductor surface. pg,24

13. An apparatus as claimed in claim 2, wherein said means for applying pressure and heat comprises heating means for heating the surface of said transport cylinder to a temperature in the range from about 100° to about 125° C.

14. An apparatus as claimed in claim 13, wherein said pressure along said line of contact is up to about 100 N/cm.

* * * * *